United States Patent [19]

Rebsamen

[11] Patent Number: 5,033,686

[45] Date of Patent: Jul. 23, 1991

[54] APPARATUS WITH AT LEAST ONE REELING STATION FOR PRODUCING THE WINDING OF A CHEESE

[75] Inventor: Arthur Rebsamen, Sellenbüren, Switzerland

[73] Assignee: Maschinenfabrik Schweiter AG, Horgen, Switzerland

[21] Appl. No.: 47,178

[22] Filed: May 6, 1987

Related U.S. Application Data

[63] Continuation of Ser. No. 742,762, Jun. 10, 1985, abandoned.

[30] Foreign Application Priority Data

Nov. 19, 1984 [CH] Switzerland ..... 5519/84

[51] Int. Cl.[5] ..... B65H 54/20

[52] U.S. Cl. ..... 242/35.5 R; 242/18 DD; 242/26; 242/43 R

[58] Field of Search ..... 242/35.5 R, 18 DD, 43 R, 242/26, 18.1, 36

[56] References Cited

U.S. PATENT DOCUMENTS

| | | | |
|---|---|---|---|
| 2,259,364 | 10/1941 | Bartholomew | 242/26 |
| 3,226,047 | 12/1965 | Noordenbos | 242/18 DD |
| 3,350,021 | 10/1967 | Marciniak | 242/35.5 R |
| 3,884,426 | 5/1975 | Hermanns | 242/26 X |
| 4,044,961 | 8/1977 | Luz | 242/35.5 R |
| 4,087,056 | 5/1978 | Wilding | 242/43 R |
| 4,515,320 | 5/1985 | Slavik et al. | 242/18 DD |

*Primary Examiner*—Stanley N. Gilreath
*Attorney, Agent, or Firm*—Bachman & LaPointe

[57] ABSTRACT

When using several reeling stations, a single drive shaft is provided for driving the drive rollers and this is driven by a single driving station. For each reeling station, a drive branch branches off from the drive shaft and has an infinitely variable gear for driving the thread laying devices. The thread supplied by a textile machine is wound in accordance with a preprogrammed winding through a regulator associated with the reeling station. The driving station can be driven by a motor or by the delivery mechanism of the textile machine with a synchronous speed or with a speed having a fixed transmission ratio, a number of reeling stations corresponding to the number of delivery mechanisms being simultaneously drivable.

3 Claims, 1 Drawing Sheet

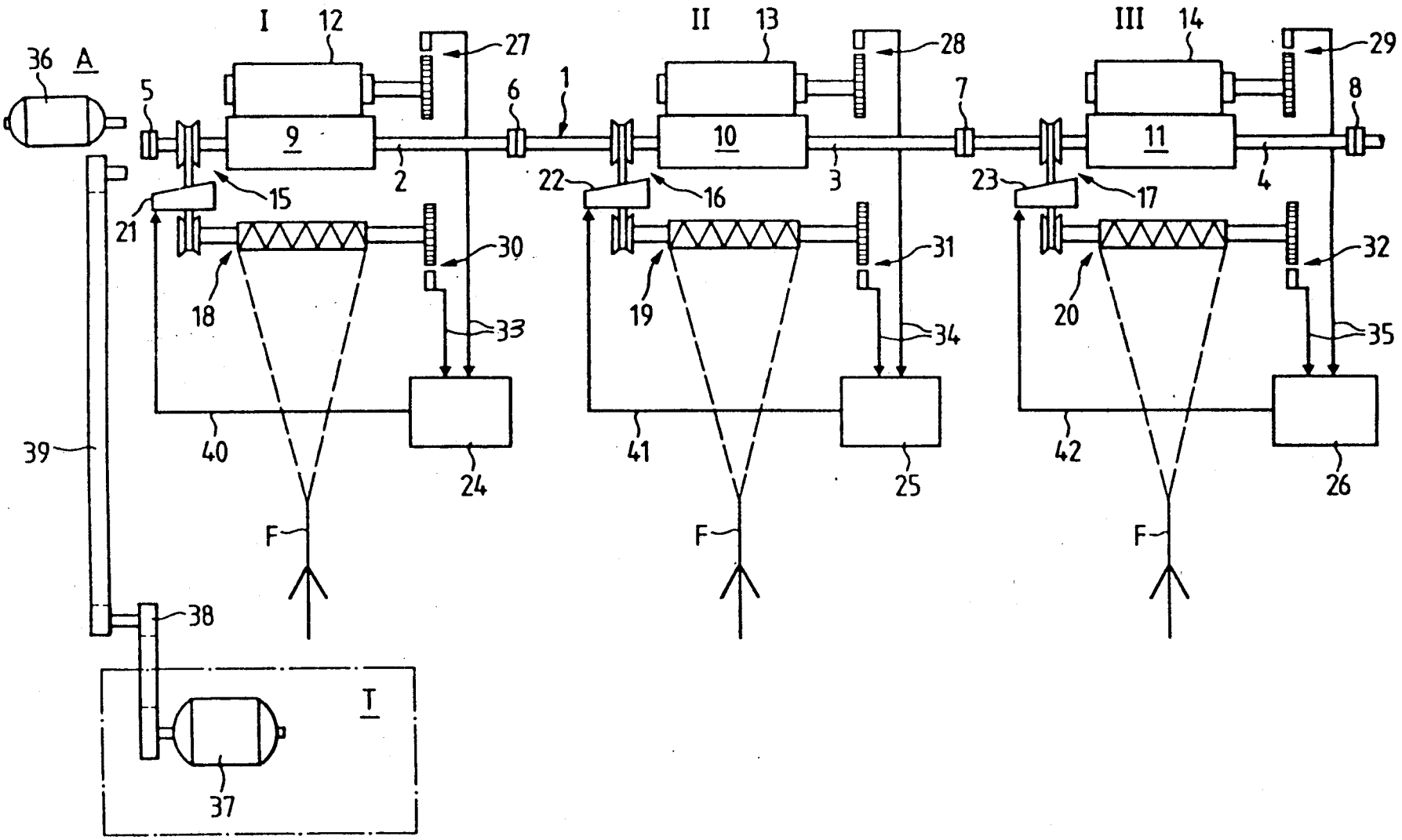
I
II
III
A
T
F
1
2
3
4
5
6
7
8
9
10
11
12
13
14
15
16
17
18
19
20
21
22
23
24
25
26
27
28
29
30
31
32
33
34
35
36
37
38
39
40
41
42

APPARATUS WITH AT LEAST ONE REELING STATION FOR PRODUCING THE WINDING OF A CHEESE

This is a continuation of U.S. application Ser. No. 742,762 filed June 10, 1985, now abandoned.

BACKGROUND OF THE INVENTION

The present invention relates to an apparatus comprising at least one reeling station for producing the winding of a cheese and which has a drive roller and a thread laying or transferring device, a driving station driving the drive roller with a fixed transmission ratio and the thread laying device via an infinitely variable gear with a variable transmission ratio and the gear is regulatable by a regulator as a function of the speed ratio of drive roller and thread laying device.

A cheese machine is known U.S. Pat. application Ser. No. 536,323, filed Sept. 27, 1983, now U.S. Pat. No. 4,515,320 which corresponds to the aforementioned reeling station. In this known machine, the regulator for regulating the transmission ratio is a processor, in which the winding of the cheese can be produced with several successive precision windings and a decreasing turns ratio. This cheese machine is characterized by a very simple construction, without its function being impaired.

SUMMARY OF THE INVENTION

The problem of the present invention is to so develop an apparatus with at least one reeling station of the aforementioned type, that the possibilities of use of the reeling station are extended.

According to the invention, this problem is solved in that when there are several reeling stations, a single driving station is provided for driving the drive rollers of the reeling stations, whereas the thread laying device of each reeling station is driven by in each case one infinitely variable gear and is regulatable by in each case one regulator.

Thus, when there are several reeling stations, the drive can be simplified in that only one motor is used. Therefore a large number of reeling stations can be driven by a single driving station, which makes it possible to use textile machines whose working stations produce a thread, e.g. on an open end spinning machine or a twisting machine, or which treat a thread, e.g. on a texturizing machine or a yarn treatment machine.

BRIEF DESCRIPTION OF THE DRAWING.

The invention is described in greater detail hereinafter relative to a non-limitative embodiment and the drawing, which is a schematic illustration showing the arrangement of several, juxtaposed reeling stations, two possibilities of driving the latter being shown.

DETAILED DESCRIPTION

The drawing shows three reeling stations I, II, III, which should be looked upon as representative of a large number of reeling stations. A common drive shaft 1 is Provided for driving the reeling stations and is subdivided into shaft sections 2, 3, 4, which are rigidly coupled together by means of couplings 5, 6, 7, 8. Said couplings permit a rapid disconnection of drive shaft 1, so that the replacement of one of the reeling stations I, II, III can take place speedily and without difficulty. Drive rollers 9, 10, 11, at a rate of one drive roller per reeling station, are fixed to the drive shaft 1 and on each of these is mounted a bobbin 12, 13, 14, driven on the circumference thereof by one of the drive rollers 9, 10, 11.

For each of the reeling stations I, II, III, a drive branch 15, 16, 17, used for driving a thread transferring or laying device 18, 19, 20 branches off from the drive shaft 1. The thread laying device 18, 19, 20 is driven by means of an infinitely variable gear 21, 22, 23, located in the drive branch 15, 16, 17. The infinitely variable gear can, for example, be a belt variator. Thus, the thread laying device 18, 19, 20, that is a reverse thread shaft, can be driven with an infinitely variable speed.

A regulator 24, 25, 26 is associated with each reeling station I, II, III and can be constructed as a programmable microprocessor. Regulator 24, 25, 26 measures the speed of bobbin 12, 13, 14 and the thread laying device 18, 29, 20, calculates the ratio of these speeds and compares the ratio found with a desired speed ratio. Divergences from the desired speed ratio are corrected by modifying the speed of the infinitely variable gear 21, 22, 23. The speed of the bobbins 12, 13, 14 is measured by a revolution counter 27, 28, 29 and the speed of the thread laying device 18, 19, 20 by a further revolution counter 30, 31, 32, the signals corresponding to the speeds being supplied via lines 33, 34, 35 to regulator 24, 25, 26, which carries out the desired actual value comparison and optionally generates a correction signal, which is supplied to the infinitely variable gear 21, 22, 23, via lines 40, 41, 42 so that its setting can be changed.

Each reeling station I, II, III is supplied with a thread F guided by the thread laying device 18, 19, 20 and which produces the winding determined in the regulator 24, 25, 26.

The reeling stations I, II, III are jointly driven by a single driving station A from where the drive shaft 1 is driven with a constant or a variable speed. A speed change does not lead to any change to the winding of bobbins 12, 13, 14, because regulator 24, 25, 26 performs the regulation on the basis of the speed ratio values.

In the drawing, two drives are provided at driving station A, one or other of the drives being chosen as a function of the nature of the use of reeling stations I,II-,III. One drive is a motor drive 36, that is an electric motor, which is directly connected to drive shaft 1 by coupling 5. The other drive takes place by means of a motor drive 37 of a textile machine T, which supplies the thread F for recling station I, II, III. For example, textile machine T can be a spinning or twisting machine, but also a texturizing or yarn treatment machine. The thread F supplied by the textile machine T is fed to a delivery mechanism with a given speed. The speed of the delivery mechanism can be transferred synchronously or with a given constant transmission ratio to drive shaft 1 via drive elements 38, 39, which are represented as mechanical transmission elements, but can also represent an electrical transmission The above apparatus has the advantage that a random number of reeling stations can be driven from a single driving station A, but the thread laying device and regulator for each reeling station are separate. If the driving station A is the drive of a textile machine T, the further advantage is obtained that bobbins having a specific winding can be wound, as was described in the earlier-dated specification referred to hereinbefore. As the delivery speed of the thread to the textile machine T is used as a measure for the speed of the reeling stations, no regulating devices have to be used for regulating the thread speed. The number of reeling stations can be chosen at random and can consequently correspond to the number of delivery mechanisms of textile machine T.

With the above apparatus not only cylindrical bobbins but also conical packages or pineapple cones can be wound.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An installation for winding cheese comprising a plurality of reeling stations, each of said reeling stations having a drive roller mounted on a drive shaft, a bobbin associated with said drive roller and driven thereby and a thread laying device mounted on a drive shaft; coupling means for releasably coupling the drive shaft of each drive roller together so as to form a common drive shaft; motor means for driving said common drive shaft; variable gear transmission means associated with said common drive shaft and the drive shaft of each thread laying device for driving the drive shaft of each thread laying device; and control means for controlling the rotational speed of the drive shaft of each thread laying device, said control means comprising means for measuring the speed of rotation of said bobbins and the speed of rotation of the drive shaft of each thread laying device and controlling said variable gear transmission in response to said sensed speeds, and thread delivery means for delivering thread, said thread delivery means being mechanically coupled by coupling means to the motor means of the drive shaft for driving the thread delivery means, said coupling means being a transmission means for operating the motor means and the thread delivery means in synchronism and fixed transmission ratio.

2. An installation for winding cheese comprising a plurality of reeling stations, each of said reeling stations having a drive roller mounted on a drive shaft, a bobbin associated with said drive roller and driven thereby and a thread laying device mounted on a drive shaft; coupling means for releasably coupling the drive shaft of each drive roller together so as to form a common drive shaft; motor means for driving said common drive shaft; variable gear transmission means associated with said common drive shaft and the drive shaft of each thread laying device for driving the drive shaft of each thread laying device; and control means for controlling the rotational speed of the drive shaft of each thread laying device, said control means comprising means for measuring the speed of rotation of said bobbins and the speed of rotation of the drive shaft of each thread laying device and controlling said variable gear transmission in response to said sensed speeds, and thread delivery means for delivering thread, said thread delivery means being electrically coupled by coupling means to the motor means of the drive shaft for driving the thread delivery means.

3. An installation for winding cheese comprising a plurality of reeling stations, each of said reeling stations having a drive roller mounted on a drive shaft, a bobbin associated with said drive roller and driven thereby and a thread laying device mounted on a drive shaft; coupling means for releasably coupling the drive shaft of each drive roller together so as to form a common drive shaft; motor means for driving said common drive shaft; variable gear transmission means associated with said common drive shaft and the drive shaft of each thread laying device for driving the drive shaft of each thread laying device; and control means for controlling the rotational speed of the drive shaft of each thread laying device, said control means comprising means for measuring the speed of rotation of said bobbins and the speed of rotation of the drive shaft of each thread laying device and controlling said variable gear transmission in response to said sensed speeds, and thread delivery means for delivering thread, said thread delivery means being mechanically coupled by coupling means to the motor means of the drive shaft for driving the thread delivery means.

* * * * *